US008891999B2

(12) United States Patent
Kawai

(10) Patent No.: US 8,891,999 B2
(45) Date of Patent: Nov. 18, 2014

(54) CLEANING MEMBER AND CHARGING DEVICE, UNIT FOR IMAGE FORMING APPARATUS AND PROCESS CARTRIDGE, AND IMAGE FORMING APPARATUS

(75) Inventor: Takeshi Kawai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 252 days.

(21) Appl. No.: 13/558,858

(22) Filed: Jul. 26, 2012

(65) Prior Publication Data

US 2013/0259513 A1 Oct. 3, 2013

(30) Foreign Application Priority Data

Mar. 27, 2012 (JP) ..... 2012-072427

(51) Int. Cl.
*G03G 15/02* (2006.01)

(52) U.S. Cl.
USPC ..... 399/100

(58) Field of Classification Search
CPC ..... G03G 15/0258; G03G 15/052; G03G 2221/0005
USPC ..... 399/100, 101, 357
See application file for complete search history.

(56) References Cited

U.S. PATENT DOCUMENTS

| | | | | |
|---|---|---|---|---|
| 8,467,697 | B2 * | 6/2013 | Kawai et al. | 399/100 |
| 8,618,200 | B2 * | 12/2013 | Guenther et al. | |
| 2011/0170897 | A1 * | 7/2011 | Hagiwara et al. | 399/100 |
| 2012/0002998 | A1 * | 1/2012 | Kawai | 399/100 |

FOREIGN PATENT DOCUMENTS

| | | | |
|---|---|---|---|
| JP | 11007204 | A * | 1/1999 |
| JP | A-2005-301000 | | 10/2005 |
| JP | A-2010-286713 | | 12/2010 |

OTHER PUBLICATIONS

Katsuta et al., JP 11-007204A, Jan. 12, 1999, Machine English translation from JPO, Detailed Description.*

* cited by examiner

*Primary Examiner* — Susan Lee
(74) *Attorney, Agent, or Firm* — Oliff PLC

(57) ABSTRACT

A cleaning member includes a core member, a foamed elastic layer in which fillers are filled in bubbles of a foamed elastic layer that are present at a surface of a side opposing to an outer circumferential surface of the core member in at least one side or both sides of ends in a longitudinal direction in the foamed elastic layer that is disposed so as to helically wind a strip shaped foamed elastic member from one end of the core member to the other end thereof in the outer circumferential surface of the core member, and a bonding layer that bonds the core member and the foamed elastic layer.

14 Claims, 9 Drawing Sheets

CLEANING MEMBER AND CHARGING DEVICE, UNIT FOR IMAGE FORMING APPARATUS AND PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-072427 filed Mar. 27, 2012.

BACKGROUND

1. Technical Field

The present invention relates to a cleaning member and a charging device, a unit for an image forming apparatus and a process cartridge, and an image forming apparatus.

2. Related Art

In an image forming apparatus using an electrophotographic system, first, a surface of an image holding member including a photoreceptor or the like is charged and an electric charge is generated, and an electrostatic latent image is formed by laser light or the like modulated by image signals. Thereafter, the electrostatic latent image is developed by charged toner and a visible toner image is formed. In addition, the toner image is electrostatically transferred to a transfer medium such as recording paper directly or via an intermediate transfer member, the toner image is fixed on the transfer medium, and the image is obtained.

SUMMARY

According to a first aspect of the present invention, there is provided a cleaning member including: a core member; a foamed elastic layer in which fillers are filled in bubbles of a foamed elastic layer that are present at a surface of a side opposing to an outer circumferential surface of the core member at least in one side or both sides of ends in a longitudinal direction in the foamed elastic layer that is disposed so as to helically wind a strip shaped foamed elastic member from one end of the core member to the other end thereof on the outer circumferential surface of the core member; and a bonding layer that bonds the core member and the foamed elastic layer.

BRIEF DESCRIPTION OF THE DRAWINGS

Exemplary embodiments of the present invention will be described in detail based on the following figures, wherein.

DETAILED DESCRIPTION

Figure 1:
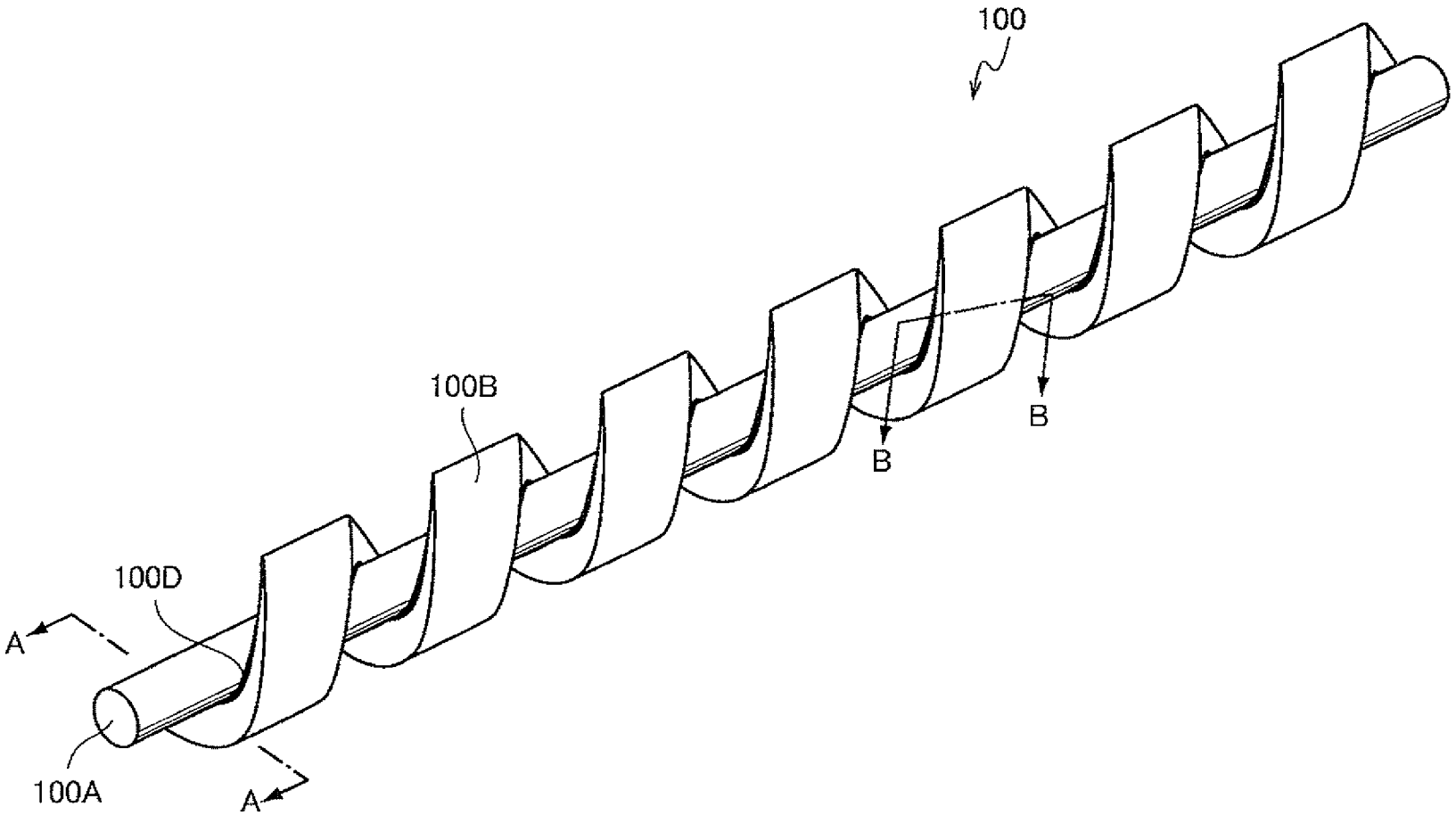
FIG. 1 is a schematic perspective view showing a cleaning member according to the present exemplary embodiment.

Hereinafter, an exemplary embodiment that is an example of the present invention will be described. In addition, the same reference numerals are attached to members having the same function and operation through overall drawings, and the description is omitted.

Cleaning Member

Figure 2:
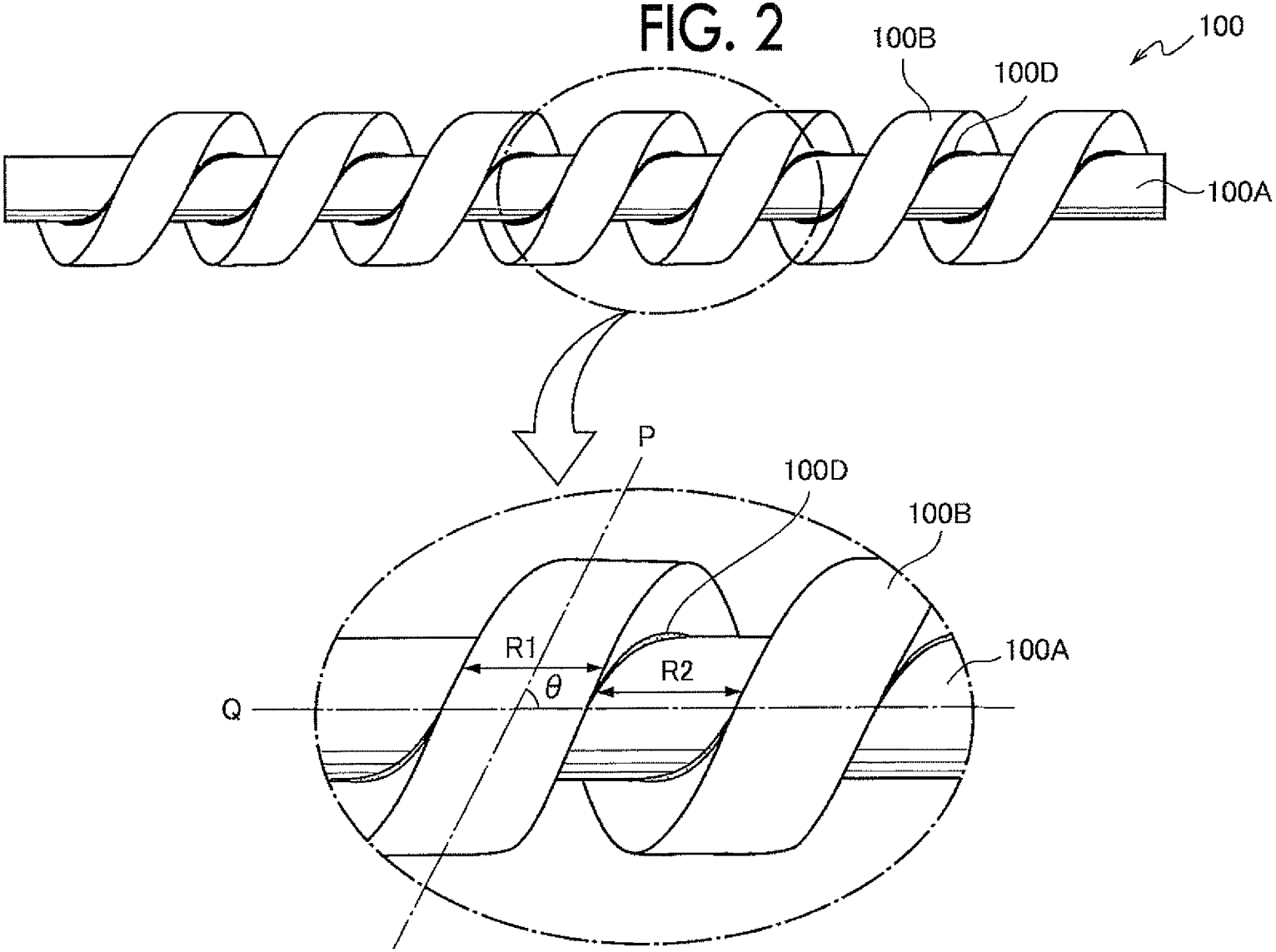
FIG. 2 is a schematic side view showing the cleaning member for the image forming apparatus according to the present exemplary embodiment.
Figure 3:
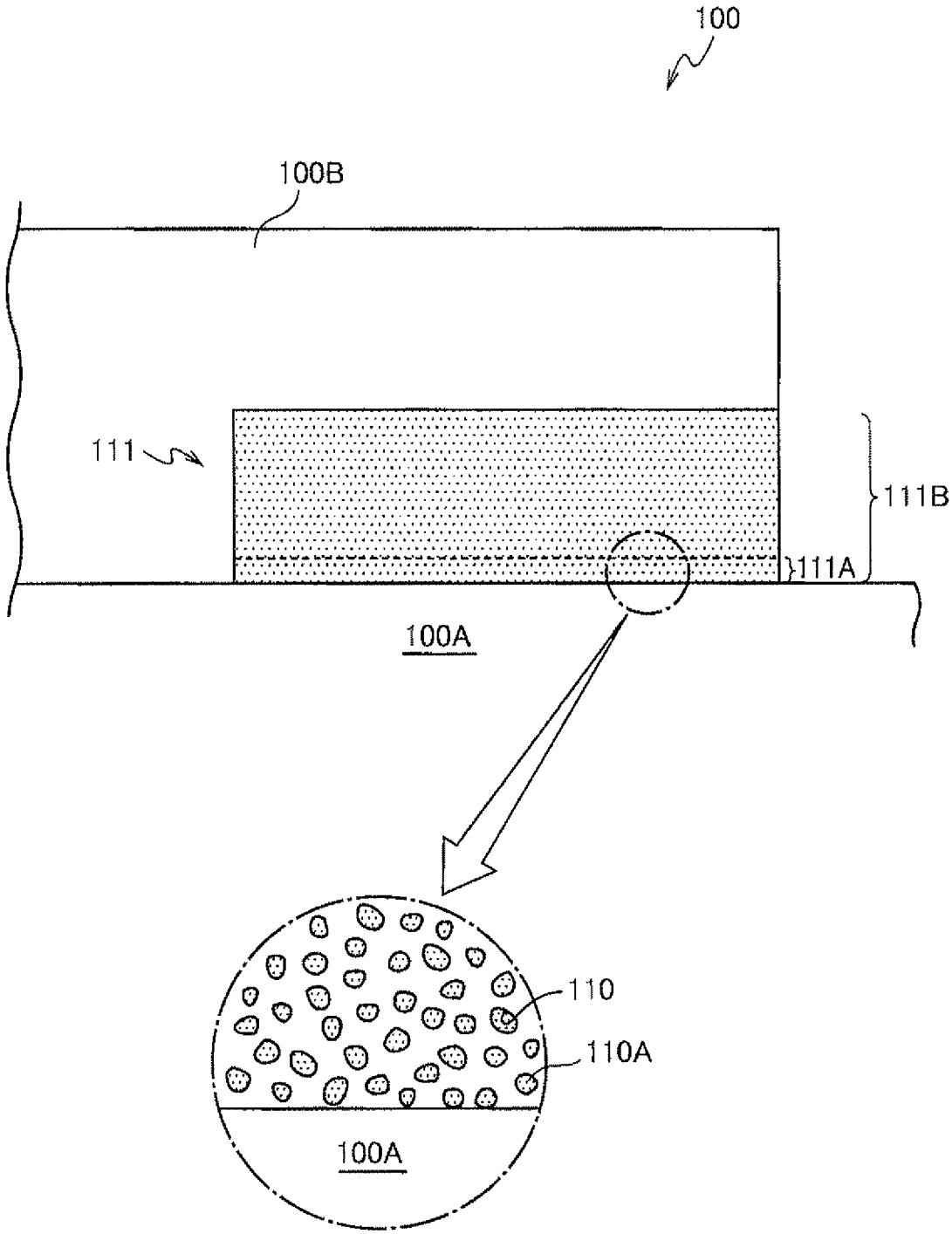
FIG. 3 is an enlarged cross-sectional view showing a foamed elastic layer in the cleaning member for the image forming apparatus according to the present exemplary embodiment.
Figure 4:
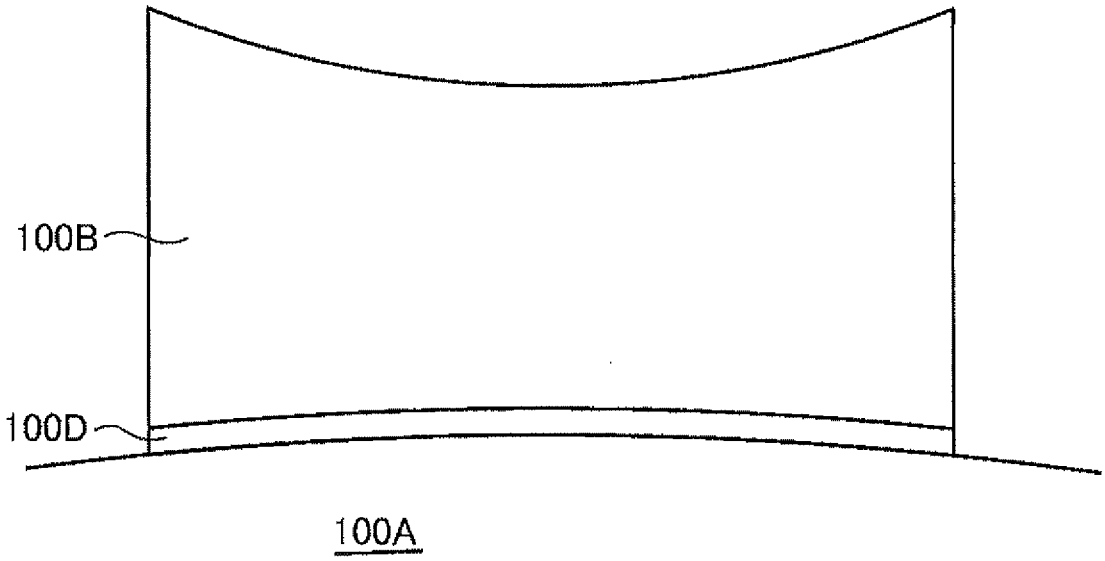
FIG. 4 is an enlarged cross-sectional view showing a foamed elastic layer in the cleaning member for the image forming apparatus according to the present exemplary embodiment.

FIG. 1 is a schematic perspective view showing a cleaning member according to the present exemplary embodiment. FIG. 2 is a schematic plan view showing the cleaning member for the image forming apparatus according to the present exemplary embodiment. FIG. 3 is an enlarged cross-sectional view showing a foamed elastic layer in the cleaning member for the image forming apparatus according to the present exemplary embodiment. FIG. 4 is an enlarged cross-sectional view showing a foamed elastic layer in the cleaning member for the image forming apparatus according to the present exemplary embodiment.

In addition, FIG. 3 is a cross-sectional view of A-A in FIG. 1, that is, is a cross-sectional view along a helical direction of the foamed elastic layer.

Moreover, FIG. 4 is a cross-sectional view of B-B in FIG. 1, that is, is a cross-sectional view along a direction perpendicular to the helical direction of the foamed elastic layer.

As shown in FIGS. 1 to 4, a cleaning member 100 for the image forming apparatus (hereinafter, simply referred to as a cleaning member) according to the present exemplary embodiment is a roll shaped member, and particularly, is a roll shaped member that includes a core member 100A, a foamed elastic layer 100B, and a bonding layer 100D for bonding the core member 100A and the foamed elastic layer 100B.

A strip shaped foamed elastic member 1000 (hereinafter, referred to as a strip 1000) is helically wind around the outer circumferential surface of the core member over from one end to the other end of the core member, and therefore, the foamed elastic layer 100B is formed. Specifically, for example, the foamed elastic layer 100E is disposed in a state where the strip 100C is helically wound with intervals while having the core member 100A as a helical axis from one end to the other end of the core member 100A.

In addition, fillers 110A are filled in bubbles 110 (hereinafter, referred to as "foamed cells 110") of the foamed elastic layer 100E that are present at a surface (hereinafter, the surface of the side opposing to the outer circumferential surface of the core member 100A of the foamed elastic layer 100B is referred to as a "lower surface") of a side opposing to the outer circumferential surface of the core member 100A in at least one side or both sides of the ends in a longitudinal direction of the foamed elastic layer 100B.

Moreover, in drawings, a reference numeral 111 indicates a region in which the fillers 110A are filled in the foamed cells 110 of the foamed elastic layer 1003.

Moreover, in the present exemplary embodiment, an aspect is shown in which the fillers 110A are filled in the foamed cells 110 that are present at the lower surface of both sides of the ends in the longitudinal direction of the foamed elastic layer 1003.

Here, in the case where the strip 100C is wound around the core member 100A and the foamed elastic layer 100B is helically disposed on the outer circumferential surface of the core member 100A, when the strip 100C is wound around the outer circumferential surface of the core member 100A, it is necessary to apply predetermined tensile strength in the longitudinal direction (winding direction). It is considered that the foamed elastic layer 1003 wound around the core member 100A is disposed in a state of being elastically deformed (for example, a state where the thickness of the center portion in the width direction of the strip 100C is decreased compared to that before being wound).

On the other hand, since the foamed elastic layer 1003 in the state of being wound around the core member 100A is fixed along the outer circumferential surface of the core member 100A in the state of being elastically deformed, it is considered that a repulsive elastic force is generated according to an elastic deformation volume of the foamed elastic layer 100B. The repulsive elastic force acts on a direction in which the foamed elastic layer 100B shrinks, that is, since the repulsive elastic force acts in the direction of the longitudinal direction (winding direction of strip 1000) of the foamed elastic layer 100B, it is considered that one side or both sides of the ends in the longitudinal direction of the foamed elastic layer 100B on the outer circumferential surface of the core member 100A are directions to be peeled. In addition, since the repulsive elastic force strongly acts as a thickness and an elastic modulus of the foamed elastic layer 100B and a curvature of the core member are increased, it is considered that the foamed elastic layer 100B is easily peeled.

In addition, since the foamed elastic layer 100B includes the foamed cells 110 (bubbles), plural concave portions due to the foamed cells 110 (foamed skeletal structure) are present on the lower surface of the foamed elastic layer 100B contacting the outer circumferential surface of the core member 100A via the bonding layer 100D, due to the concave portions, the region that actually contacts the outer circumferential surface of the core member 100A via the bonding layer 100D in the lower surface of the foamed elastic layer 100E tends to be low in the bonding through the bonding layer 100D between the lower surface of the foamed elastic layer 100E and the outer circumferential surface of the core member 100A compared to a non-foamed elastic layer, and it is considered that the bond strength is easily insufficient.

Therefore, in the cleaning member 101 according to the present exemplary embodiment, the fillers 110A are filled in the foamed cells 110 that are present on the lower surface of the foamed elastic layer 1003 in at least one side or both sides of the ends in the longitudinal direction.

Thereby, in at least one side or both sides of the ends in the longitudinal direction of the foamed elastic layer 100B, a total area of the region (portion) that directly contacts the core member 100A via the bonding layer 100D in the lower surface of the foamed elastic layer 100B is increased, it is considered that the larger bond strength is obtained, and peeling of the foamed elastic layer 100E from the core member 100A (particularly, the peeling from the ends in longitudinal direction of the foamed elastic layer 100B) is suppressed.

Moreover, when the cleaning member 101 is stored for a period of time (for example, 24 hours or more) in a high temperature environment (for example, under a condition of the temperature of 50° C.), the viscosity of the bonding layer 1000 that bonds the foamed elastic layer 100B and the core member 100A becomes weak, and the peeling of the foamed elastic layer 100B from the core member 100A (particularly, the peeling from the ends in the longitudinal direction of the foamed elastic layer 100B) easily occurs. However, in the cleaning member 101 according to the present exemplary embodiment, even when the cleaning member is stored for a period of time in the high temperature environment, the peeling of the foamed elastic layer 100B from the core member 100A (particularly, the peeling from the ends in the longitudinal direction of the foamed elastic layer 100B) is suppressed.

In addition, in a charging device, a process cartridge, and an image forming apparatus including the cleaning member 100 according to the present exemplary embodiment, since the peeling of the foamed elastic layer 100B from the core member 100A (particularly, the peeling from the ends in the longitudinal direction of the foamed elastic layer 100B) is suppressed, a decrease in charging performance due to a cleaning failure of the charging member and the image defect (for example, concentration unevenness) due to that are suppressed.

Hereinafter, each member will be described.

First, the core member will be described.

Examples of the material used in the core member 100A includes a metal (for example, free-cutting steel, stainless steel, or the like), or a resin (for example, polyacetal resin (POM) or the like). In addition, the material, the surface treatment method, and the like may be preferably selected as necessary.

Particularly, when the core member 100A is configured of a metal, plating may be preferably performed. In addition, when the core member 100A is configured of a nonconductive material such as resin, the core member may be processed by a general processing such as plating and be subjected to a conductive processing, or may be used as it is without processing.

Next, the bonding layer will be described.

The bonding layer is not particularly limited as long as the layer may bond the core member 100A and the foamed elastic layer 100B. For example, the bonding layer includes double-sided tape and the other adhesives.

Next, the foamed elastic layer will be described.

The foamed elastic layer 100B is configured of a material (so-called foamed body) having foamed cells 110 (bubbles).

For example, examples of the material of the foamed elastic layer 100B include materials in which one kind or two kinds or more of foamed resin such as polyurethane, polyethylene, polyamide, and polypropylene, or rubber material such as silicon rubber, fluoro rubber, urethane rubber, EPDM (ethylene propylene diene rubber), NBR (Acrylonitril butadiene rubber), CR (chloroprene rubber), chlorinated polyisoprene, isoprene, acrylonitrile-butadiene rubber, styrene-butadiene rubber, hydrogenated polybutadiene, and butyl rubber are blended.

In addition, auxiliaries such as foaming auxiliaries, foam stabilizers, catalysts, curing agents, plasticizers, and vulcanization accelerator may be added to these as necessary.

From a viewpoint of preventing the surface of a member to be cleaned from being damaged due to scratch and preventing the foamed elastic layer 100B from being cut or damaged over a long period, foamed polyurethane having enough tensile strength may be preferably used.

As the polyurethane, for example, there is a reactant of polyol (for example, polyester polyol, poly ethel polyester, acrylic polyol, or the like) and isocyanate (for example, 2, 4-tolylene diisocyanate, 2, 6-tolylene diisocyanate, 4, 4-diphenyl methane isocyanate, tolidine diisocyanate, 1, 6-hexamethylene diisocyanate, or the like), and chain extenders (1, 4-butanediol or trimethylol propane) may be contained.

In addition, in general, foaming of the polyurethane is performed using for example, a foaming agent such as water or azo compounds (for example, azodicarbonamide, azobisisobutyronitrile, or the like).

Auxiliaries such as foaming auxiliaries, foam stabilizers and catalysts may be added to the foamed polyurethane as necessary.

In addition, ether-based foamed polyurethane may be preferably used among the foamed polyurethanes. The reason is that the ester-based foamed polyurethane tends to be easily hydrothermally aged. In general, silicone oil foam stabilizers are used for the ether-based polyurethane. However, in storage (particularly, long-term storage in high temperature and high humidity), the silicone oil may migrate to the member to be cleaned (for example, charging roll or the like) and as a result image quality defects may occur. Thereby, foam stabilizers other than silicone oil are used, and therefore, image quality defects of the foamed elastic layer 100B are suppressed.

Here, specifically, as foam stabilizers other than silicone oil, there is an organic surfactant that does not contain Si (for example, anionic surfactants such as dodecylbenzenesulfonic acid and sodium lauryl sulfate). In addition, a method without using the silicone-based foamed stabilizers described in JP-A-2005-301000 may be applied.

In addition, whether or not the ester-based foamed polyurethane used foam stabilizers other than silicone oil is determined by whether or not the ester-based foamed polyurethane contains "Si" according to component analysis.

For example, the thickness (thickness of the center portion in the width direction) of the foamed elastic layer 100B may be from 1.0 mm to 3.0 mm, is preferably from 1.4 mm to 2.6 mm, and is more preferably from 1.6 mm to 2.4 mm.

In addition, for example, the thickness of the foamed elastic layer 100E is measured as follows.

In a state where the circumferential direction of the cleaning member is fixed, a laser measuring machine (laser scan micrometer manufactured by Mitutoyo Corporation, type LSM 6200) scans in the longitudinal direction (axial direction) of the cleaning member in a transverse speed of 1 mm/s, and measurement on a profile of the thickness of the foamed elastic layer (wall thickness of the foamed elastic layer) is performed. Thereafter, the similar measurement is performed while the position in the circumferential direction is shifted (positions of the circumferential direction are intervals of 120° and are three places). Calculation on the thickness of the foamed elastic layer 1005 is performed based on the profile.

The foamed elastic layer 100B is helically disposed. Specifically, for example, a helical angle θ may be from 10° to 65° (preferably, 20° to 50°), a helical width R1 may be from 3 mm to 25 mm (preferably, 3 mm to 10 mm). In addition, for example, a helical pitch R2 may be from 3 mm to 25 mm (preferably from 15 mm to 22 mm).

A coverage of the foamed elastic layer 100B (the helical width R1 of the foamed elastic layer 100B/(the helical width R1 of the foamed elastic layer 100B+the helical pitch R2 of the foamed elastic layer 100B: (R1+R2))) may be from 20% to 70%, preferably from 25% to 55%.

If the coverage is greater than the range, since the time in which the foamed elastic layer 100B contacts the member to be cleaned is increased, a tendency in which materials stuck to the surface of cleaning member contaminate the member to be cleaned again is increased. On the other hand, if the coverage is smaller than the range, the thickness (wall thickness) of the foamed elastic layer 100E is difficult to be stabilized, and cleaning ability tends to be decreased.

In addition, the helical angle θ means an angle (acute angle) in which the longitudinal direction P (helical direction) of the foamed elastic layer 100B and an axial direction Q of the cleaning member (the axial direction of the core member) intersect with each other.

The helical width R1 means a length of the foamed elastic layer 100B along the axial direction Q of the cleaning member 100 (the axial direction of the core member).

The helical pitch R2 means a length between the foamed elastic layers 100B adjacent to each other along the axial direction Q of the cleaning member 100 (the axial direction of the core member).

In addition, the foamed elastic layer 100B means a layer that is configured of a material that returns to its original shape even when deformed by the applied external force of 100 Pa.

Next, the fillers 110A will be described.

The fillers 110A are filled in the foamed cells 110 (bubbles) of the foamed elastic layer 100E that is present on the lower surface of at least one side or both sides of the ends in the longitudinal direction of the foamed elastic layer 100B.

The fillers 110A may be filled in the foamed cells 110 that are present on the lower surface of the foamed elastic layer 100B. However, from a viewpoint of further suppressing the peeling of the foamed elastic layer 100E from the core member 100A, the fillers 110A may be preferably filled in the foamed cells 110 of a region 111A that is from the lower surface of the foamed elastic layer 100E up to 0.2 mm (preferably 0.6 mm) of the foamed elastic layer 100B along the thickness direction of the foamed elastic layer 100B in at least one side or both sides of the ends in the longitudinal direction of the foamed elastic layer 100B.

Thereby, it is considered that the fillers 110A filled in the foamed cells 110 that are present on the lower surface of the foamed elastic layer 100B are not easily removed from the foamed cells 110 due to stress applied to the foamed elastic layer 100B, the peeling of the foamed elastic layer 100B from the core member 100A is more easily suppressed.

On the other hand, from a viewpoint that the ends of the foamed elastic layer 100B, in which the fillers are filled in the foamed cells, also have a cleaning function to the member to be cleaned, the fillers 110A may be preferably filled in the foamed cells 110 of a region 111B that is from the lower surface of the foamed elastic layer 100B up to half (preferably, a ¼) the thickness of the foamed elastic layer 100E along the thickness direction of the foamed elastic layer 100B in at least one side or both sides of the ends in the longitudinal direction of the foamed elastic layer 100B.

Thereby, the elasticity of the surface layer side of the foamed elastic layer 100B is maintained, and unfilled foamed cells 110 are present at the surface layer side. Therefore, the ends of the foamed elastic layer 100B in which the fillers 110A are filled in the foamed cells 110 also have a cleaning function to the member to be cleaned. As a result, it is not necessary to increase the length in the axial direction of the cleaning member 100 in order to prevent damage to the cleaning surface of the member to be cleaned due to the surface of the ends of the foamed elastic layer 100B in which elasticity is decreased by filling the fillers in the foamed cells 110 or prevent the ends of the foamed elastic layer 100E from contacting the member to be cleaned in order to avoid damage.

That is, in at least one side or both sides of the ends in the longitudinal direction of the foamed elastic layer 100B, the region 111 in which the fillers 110A is filled in the foamed cells 110 may be a region which is interposed between a lower surface and an upper surface of the region 111 so that the upper surface of the region 111 is present within a range from 0.2 mm of the foamed elastic layer 100B to half the thickness of the foamed elastic layer 100B while having the lower surface of the foamed elastic layer 100B as the lower surface.

In addition, in the region 111, bubbles that are present at the boundary of the enclosure from the lower surface to 0.2 mm of the foamed elastic layer 100B or from the lower surface to half the thickness of the foamed elastic layer 100B are regarded as bubbles that are present within the region 111.

As the fillers 110A, from a viewpoint of being filled in the foamed cells 110 of the foamed elastic layer 100B, there are curable resin and thermoplastic resin. Moreover, after resin having lower viscosity or liquid resin as the fillers 110A is filled in the foamed cells 100 of the foamed elastic layer 100B, the resin are hardened or dried, and thereby, the fillers 110A are filled in the foamed cells 110.

In the fillers 110A, as the curable resin, for example, there are phenolic resin, melamine resin, epoxy resin, urea resin, unsaturated polyester resin, alkyd resin, polyurethane, curable polyimide, silicone resin, and the like, and as the thermoplastic resin, there are vinyl chloride resin, polyethylene, polypropylene, polystyrene, polyvinyl acetate, Teflon (registered trademark), ABS resin, acrylic resin, and the like. However, the curable resin and the thermoplastic resin are not limited to those described above.

Particularly, in the fillers 110A, since having elasticity is desirable from a viewpoint of securing the winding workability of the foamed elastic layer 100B to the core member 100A, and having an adhesive property is desirable from a viewpoint of maintaining the fillers in the foamed elastic layer 100B, as the curable resin, polyurethane resin and silicone resin may be selected.

Since the fillers 110A have elasticity, rigidity of the foamed elastic layer 100B (strip 100C) is suppressed, the foamed elastic layer 100B is easily wound in accordance with a curvature of the outer circumferential surface of the core member 100A, and the peeling of the foamed elastic layer 100B from the core member 100A is further suppressed.

In addition, the fillers 110A having elasticity means that the fillers are configured of a material that returns to its original shape even when being deformed by the applied external force of 100 Pa.

Here, for example, diameters of the foamed cells (diameters of bubbles) of the foamed elastic layer 100E (strip 100C) may be from 0.1 mm to 1.0 mm, are preferably from 0.2 mm to 0.9 mm, and are more preferably from 0.4 mm to 0.8 mm.

In addition, the diameters of the foamed cells (diameter of bubbles) mean an "average diameter of the cells" (average diameter of bubbles), and are calculated from 25 mm/the number of cells by measuring the number of cells for each 25 mm in the length based on the First Annex of JIS K 6400-1 (2004).

Here, in the present exemplary embodiment, the aspect is shown in which the fillers 110A are filled in the foamed cells 110 of the foamed elastic layer 100B that are present at the lower surface of at least one side or both sides of the ends in the longitudinal direction of the foamed elastic layer 100B. However, the filler 110A may be filled in the entire region of the lower surface of the foamed elastic layer 100B.

Figure 5:
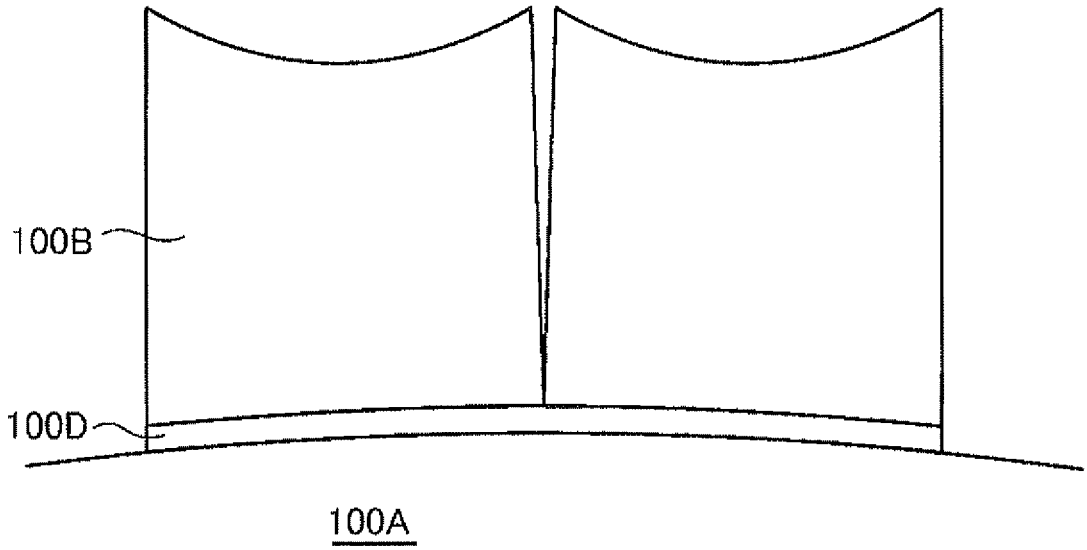
FIG. 5 is an enlarged cross-sectional view showing a foamed elastic layer in a cleaning member according to another exemplary embodiment.

In addition, the foamed elastic layer 100B is not limited to the aspect including a single strip 100C. As shown in FIG. 5, the foamed elastic layer 100B may include at least two or more strips 1000 (strip shaped foamed elastic members), and the two or more strips 100C may be configured to be disposed so as to be helically wound around the core member 100A.

Since the configuration is used in which the foamed elastic layer 100B including the two or more strips 1000 is helically wound around the core member 100A, cleaning performance of the cleaning member 100 is easily improved.

The cleaning performance is improved as the winding frequency of the strip 1000 is increased. However, for example, the helical width R1 of the foamed elastic layer 1002 at the time of winding may be from 3 mm to 25, and is preferably from 3 mm to 10 mm.

In a case where the helical width R1 is equal to or less than 3 mm, sufficient improvement effect of the cleaning performance may not be obtained even though two or more strips 1000 configuring the foamed elastic layer 100B are used.

Moreover, in the foamed elastic layer 100B this is configured so as to helically wind two or more strips 1000 (strip shaped foamed elastic members) around the core member 100A, the foamed elastic layer may be disposed so as to be helically wound in a state where sides in the longitudinal direction of a bonding surface of the strip 1000 (surface of the side opposing to the outer circumferential surface of the core member 100A in the strip 1000) contact each other, and the foamed elastic layer may be disposed so as to be helically wound in a state where the sides does not contact each other.

Particularly, for example, when the foamed elastic layer 100B is disposed so as to be helically wound in the state where the sides in the longitudinal direction of the bonding surface of two strips 1000 contact each other (refer to FIG. 5), compared to a case where a single foamed elastic member is used while having the same helical pitch R1 (refer to FIG. 4), it is considered that improved cleaning performance is easily obtained due to generation of a high contact pressure to the member to be cleaned.

In addition, FIG. 5 shows the aspect at which the foamed elastic layer 100B includes two strips 1000 (strip shaped foamed elastic members) and the foamed elastic layer is disposed so as to be helically wound in the state where the sides in the longitudinal direction of the bonding surface of two strips 1000 (surface of the side opposing to the outer circumferential surface of the core member 100A in the strip 100C) contact each other.

Next, a method of manufacturing the cleaning member 100 according to the present exemplary embodiment will be described.

Figure 6A:
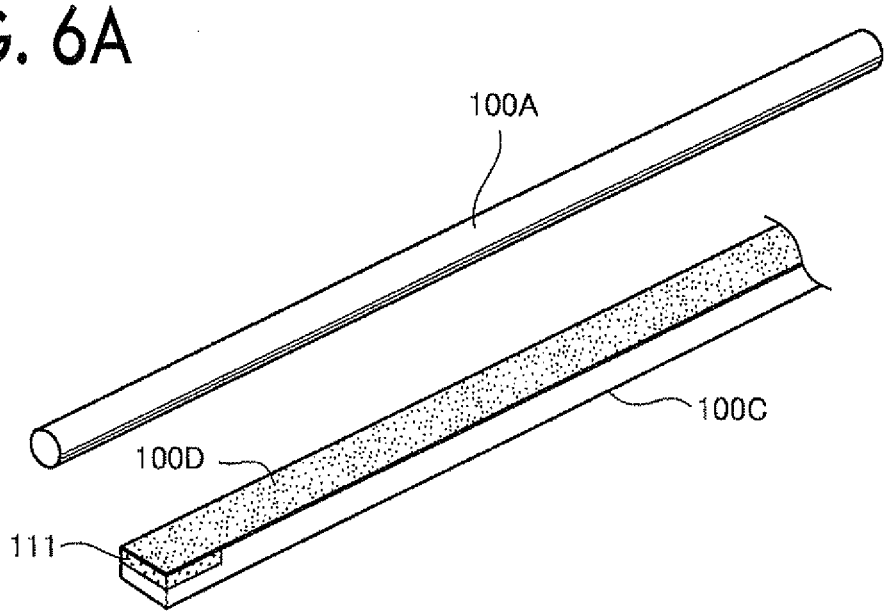
FIGS. 6A to 6C are process diagrams showing an example of a method of manufacturing the cleaning member for the image forming apparatus according to the present exemplary embodiment.
Figure 6B:
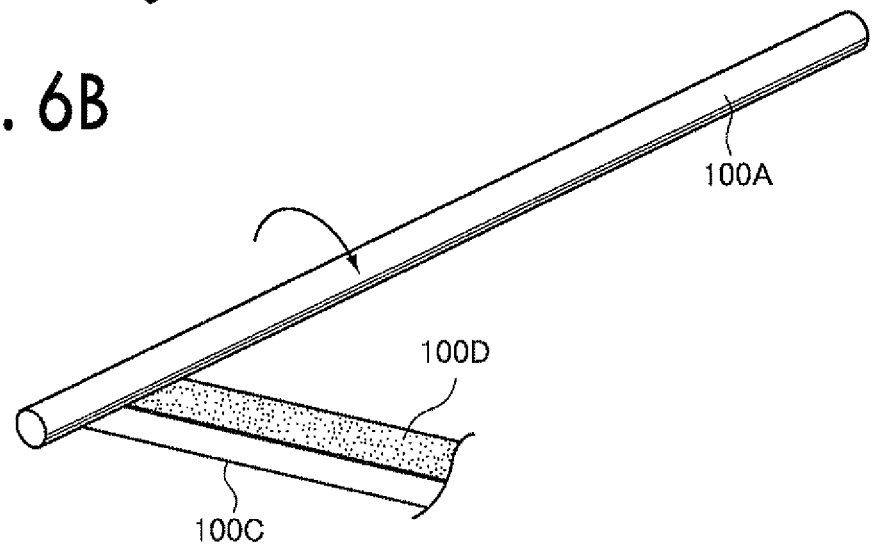
Figure 6C:
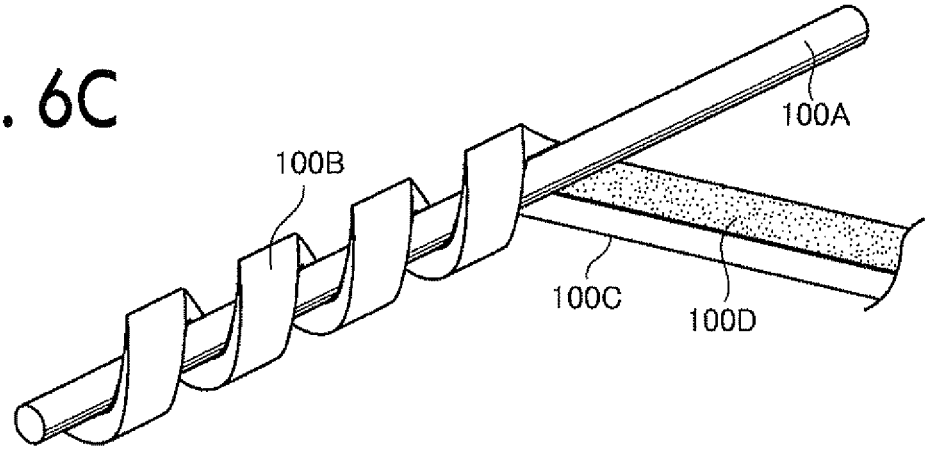

FIGS. 6A to 6C are process diagrams showing an example of the method of manufacturing the cleaning member 100 according to the present exemplary embodiment.

First, as shown in FIG. 6A, a sheet-like foamed elastic member (foamed polyurethane sheet, or the like) that is sliced so as to be a predetermined thickness is prepared, after a double-sided tape which is the bonding layer 1000 is stuck to one side surface of the sheet-like foamed elastic member, the member is punched out by a punching tool, and the strip 1000 (the strip shaped foamed elastic member to which the double-sided tape is attached) having an objective width and length is obtained. On the other hand, the core member 100A is also prepared.

Figure 7A:
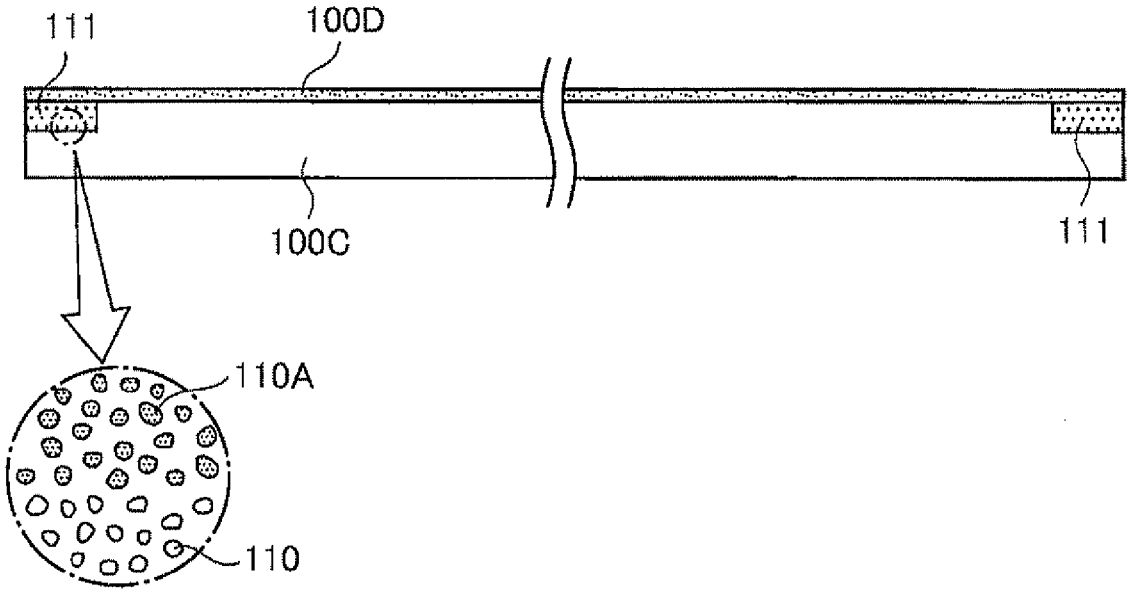
FIGS. 7A and 7B are schematic side cross-sectional views showing a strip (strip shaped foamed elastic member) of the cleaning member for the image forming apparatus according to the present exemplary embodiment.

Here, when the fillers 110A are filled in the foamed cells 110 that are present at the lower surface of both sides of the ends in the longitudinal direction of the formed foamed elastic layer 100B, as shown in FIG. 7A, the fillers 110A are filled in the foamed cells 110, which are present at the lower surface of the ends in the longitudinal direction of the prepared strip 100C, in advance.

Specifically, for example, after a liquid curable resin which is the fillers 110A or the like is impregnated into the foamed cells 110 from the surface corresponding to the lower surface of the ends in the longitudinal direction of the obtained strip 1000 in one side surface of the prepared sheet-like foamed elastic member, and the curable resin is cured and filled.

Thereafter, after the double-sided tape which is the bonding layer 1000 is stuck, the member is punched out by a punching tool, and an objective strip 100C is obtained.

In addition, the curing of the liquid curable resin which is the fillers 110A may be performed after the double-sided tape is stuck and may be performed after the strip 1000 is wound around the core member 100A.

Figure 7B:
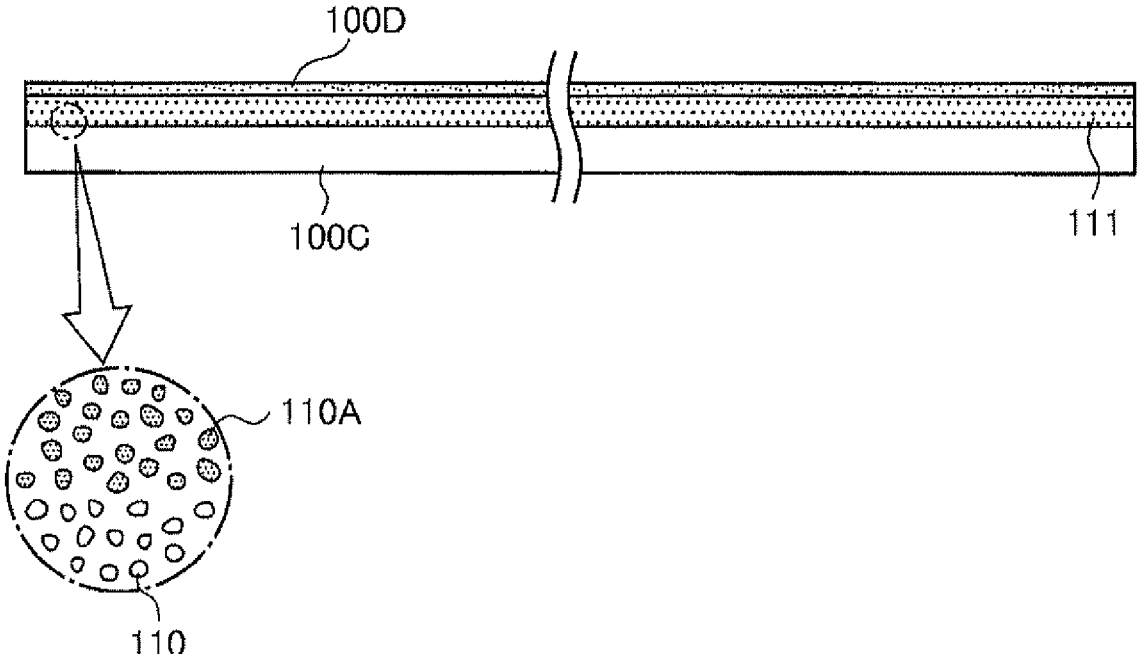

Moreover, when the fillers 110A are filled in the foamed cells 110 that are present at the entire lower surface of the formed foamed elastic layer 100B, as shown in FIG. 7B, the fillers 110A are filled in the foamed cells 110, which are present at the lower surface of the ends in the longitudinal direction of the prepared strip 100C, in advance.

Next, as shown in FIG. 6B, the strip is disposed while having the surface to which the double-sided tape is stuck as the upper surface, and in this state, one end of a release paper of the double-sided tape is peeled, and one end of the core member 100A is placed on the double-sided tape in which the release paper is peeled.

Next, as shown in FIG. 6C, the core member 100A is rotated at an objective speed while the release paper of the double-sided tape is peeled, the strip 100C is helically wound around the outer circumferential surface of the core member 100A, and the cleaning member 100 including the elastic layer 100B that is helically disposed around the outer circumferential surface of the core member 100A is obtained.

Here, when the strip 1000 that becomes the elastic layer 100B is wound around the core member 100A, the strip 100C may be positioned so that the longitudinal direction of the strip 1000 is an objective angle (helical angle) with respect to the axial direction of the core member 100A. In addition, for example, an outer diameter of the core member 100A may be approximately from ϕ3 mm to ϕ6 mm.

The tensile strength applied when the strip 1000 is wound around the core member 100A may be an extent in which a gap is not generated between the core member 100A and the double-sided tape of the strip 1000, and applying of excessive tensile strength is undesirable. If the tensile strength is excessively applied, a tensile permanent elongation is increased, the elastic force of the foamed elastic layer 100B that needs in the cleaning may be decreased. Specifically, for example, the tensile strength that provides the elongation of approximately above 0% to 5% with respect to the original length of the strip 100C may be applied.

On other hand, if the strip 1000 is wound around the core member 100A, the strip 1000 may be elongated. The elongation is different depending on the thickness direction of the strip 100C, the maximum elongation is generated at the outermost portion of the strip, and the elastic force may be decreased at the outermost portion.

The elongation is controlled by a radius of curvature when the strip 100C is wound around the core member 100A and the thickness of the strip 100C, and the radius of curvature when the strip 1000 is wound around the core member 100A is controlled by the outer diameter of the core member 100A and the winding angle of the strip 100C.

For example, the radius of curvature when the strip 1000 is wound around the core member 100A may be from ((outer diameter of core member/2)+0.2 mm) to ((outer diameter of core member/2)+8.5 mm)), and is preferably from ((outer diameter of core member/2)+0.5 mm) to ((outer diameter of core member/2)+7.0 mm)). For example, the thickness of the strip 100C may be approximately from 1.5 mm to 4 mm, and is preferably from 1.5 mm to 3.0 mm. In addition, the width of the strip 1000 may be adjusted so that the coverage of the foamed elastic layer 100B is in the above-described range. Moreover, for example, the length of the strip 1000 is determined by the length in the axial direction of the region in which the strip is wound around the core member 100A, the winding angle, and the tensile strength at the time of being wound.

Image Forming Apparatus or the Like

Hereinafter, the image forming apparatus according to the present exemplary embodiment will be described with reference to the drawings.

Figure 8:
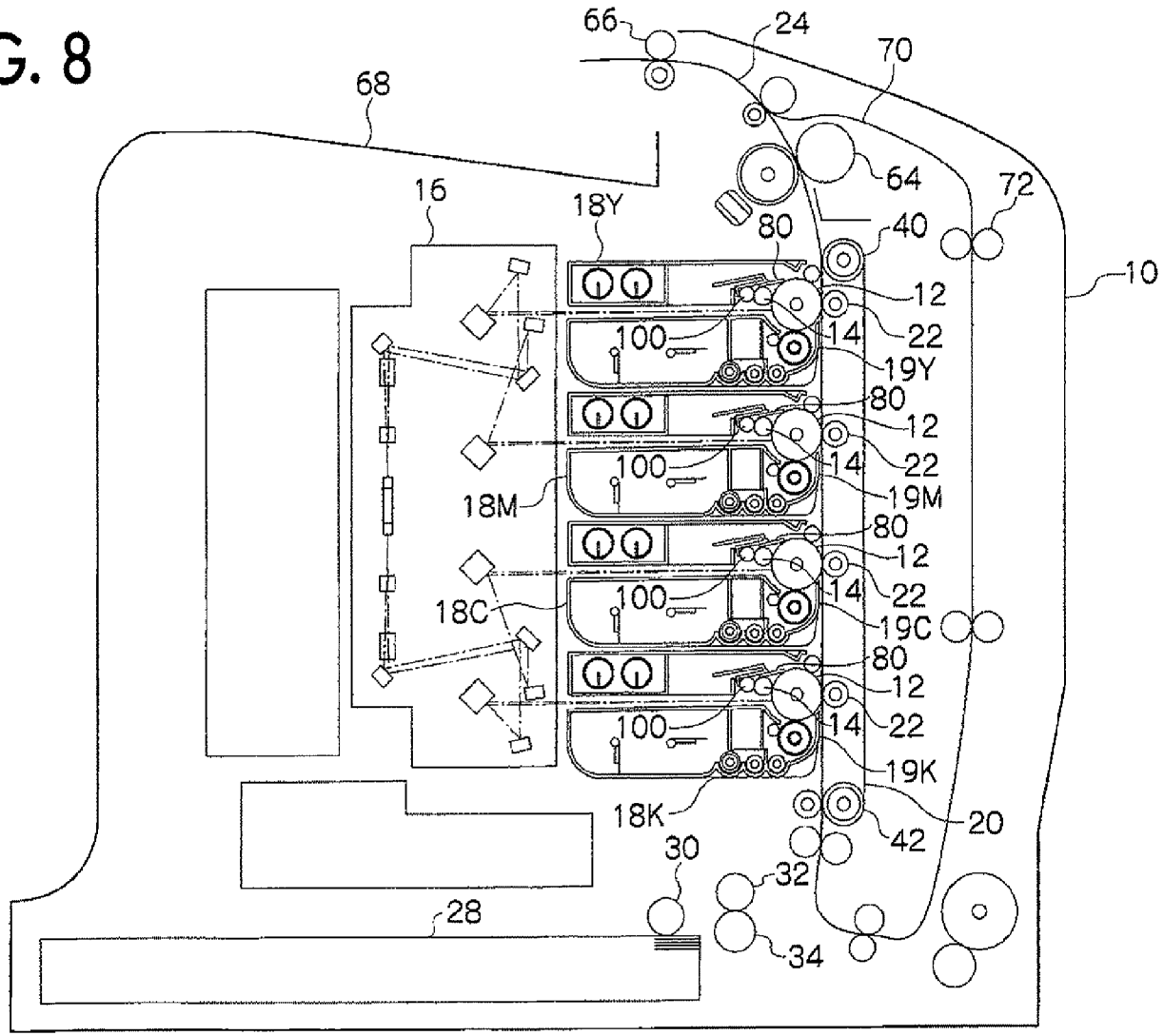
FIG. 8 is a schematic configuration view showing an electrophotographic image forming apparatus according to the present exemplary embodiment.

FIG. 8 is a schematic configuration view showing the image forming apparatus according to the present exemplary embodiment.

Figure 9:
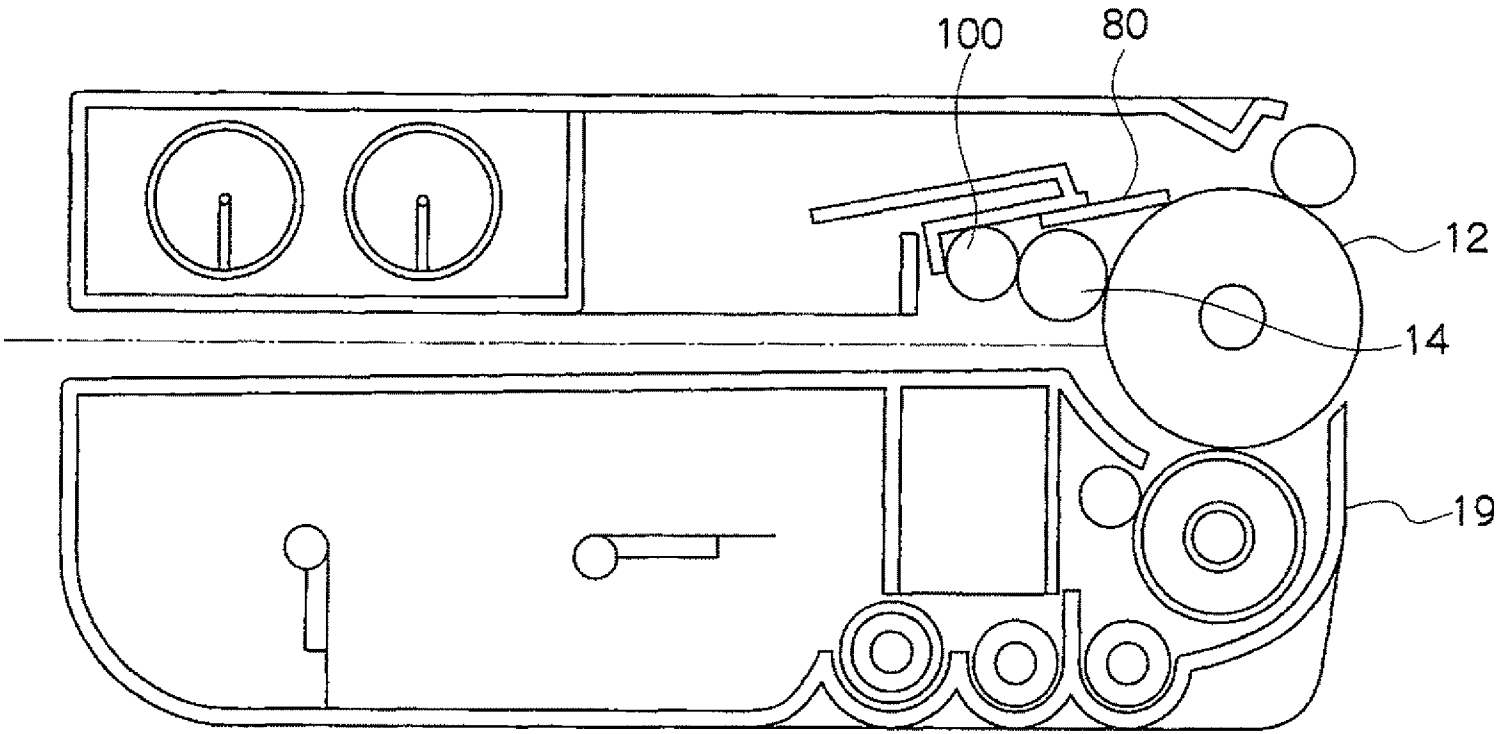
FIG. 9 is a schematic configuration view showing a process cartridge according to the present exemplary embodiment.

For example, as shown in FIG. 8, the image forming apparatus 10 according to the present exemplary embodiment is a color image forming apparatus of a tandem system. In the inner portion of the image forming apparatus 10 according to the present exemplary embodiment, a photoreceptor (image holding member) 12, a charging member 14, a developing device, and the like respectively are provided as a process cartridge (refer to FIG. 9) for each color of yellow (18Y), magenta (18M), cyan (18C), and black (18K). The process cartridge is configured so as to be detachable from the image forming apparatus 10.

For example, as the photoreceptor 12, a conductive cylindrical body in which a photoreceptor layer including an organic photosensitive material or like is coated on the surface and which has a diameter of 25 mm is used, and the photoreceptor 12 is rotated at an objective process speed by a motor (not shown).

After the surface of the photoreceptor 12 is charged by the charging member 14 that is disposed on the surface of the photoreceptor 12, image exposure is performed by a laser beam LB emitted from an exposure device 16 at a downstream side in the rotating direction of the photoreceptor 12 from the charging member 14, and an electrostatic latent image is formed according to the image information.

The electrostatic latent image formed on the photoreceptor 12 is developed by developing devices (19Y, 19M, 19C, and 19K) of each of yellow (Y), magenta (M), cyan (C), and black (K), and becomes the toner image for each color.

For example, when a color image is formed, each process of the charging, the exposure, and the developing is performed in response to each color of yellow (Y), magenta (M), cyan (C) and black (K) on the surface of the photoreceptor 12 for each color, and the toner image in response to each color of yellow (Y), magenta (M), cyan (C) and, black (K) is formed on the surface of the photoreceptor 12 for each color.

The toner image of each color of yellow (Y), magenta (M), cyan (C), and black (K) that are sequentially formed on the photoreceptor 12 is transferred to a recording paper 24 that is transported on a paper transporting belt 20 at the outer circumference of the photoreceptor 12 in a place, in which the photoreceptor 12 and a transfer device 22 contact each other, via the paper transporting belt 20 which is supported from the inner circumferential surface while being subjected to tensile strength from support rolls 40 and 42. Moreover, the recording paper 24 to which the toner image has been transferred from the photoreceptor 12 is transported to a fixing device 64, the recording paper is heated and pressurized by the fixing device 64, and the toner image is fixed on the recording paper 24. Thereafter, at a case of a single-sided printing, the recording paper 24 to which the toner image is fixed is discharged to a discharging portion 68 provided on the upper portion of the image forming apparatus 10 by a discharge roll 66 as it is.

Moreover, the recording paper 24 is taken out by a take-out roller 30 from a paper storage container 28, and is transported up to the paper transporting belt 20 by the transport rolls 32 and 34.

In addition, in the surface of the photoreceptor 12 after the transfer process of the toner image ends, residual toner, paper dust, and the like are removed by a cleaning blade 80 that is disposed further downstream in the rotation direction of the photoreceptor 12 than the place to which the transfer device 22 contacts in the surface of the photoreceptor 12 for each single rotation of the photoreceptor 12, and the next image forming process is prepared.

Figure 10:
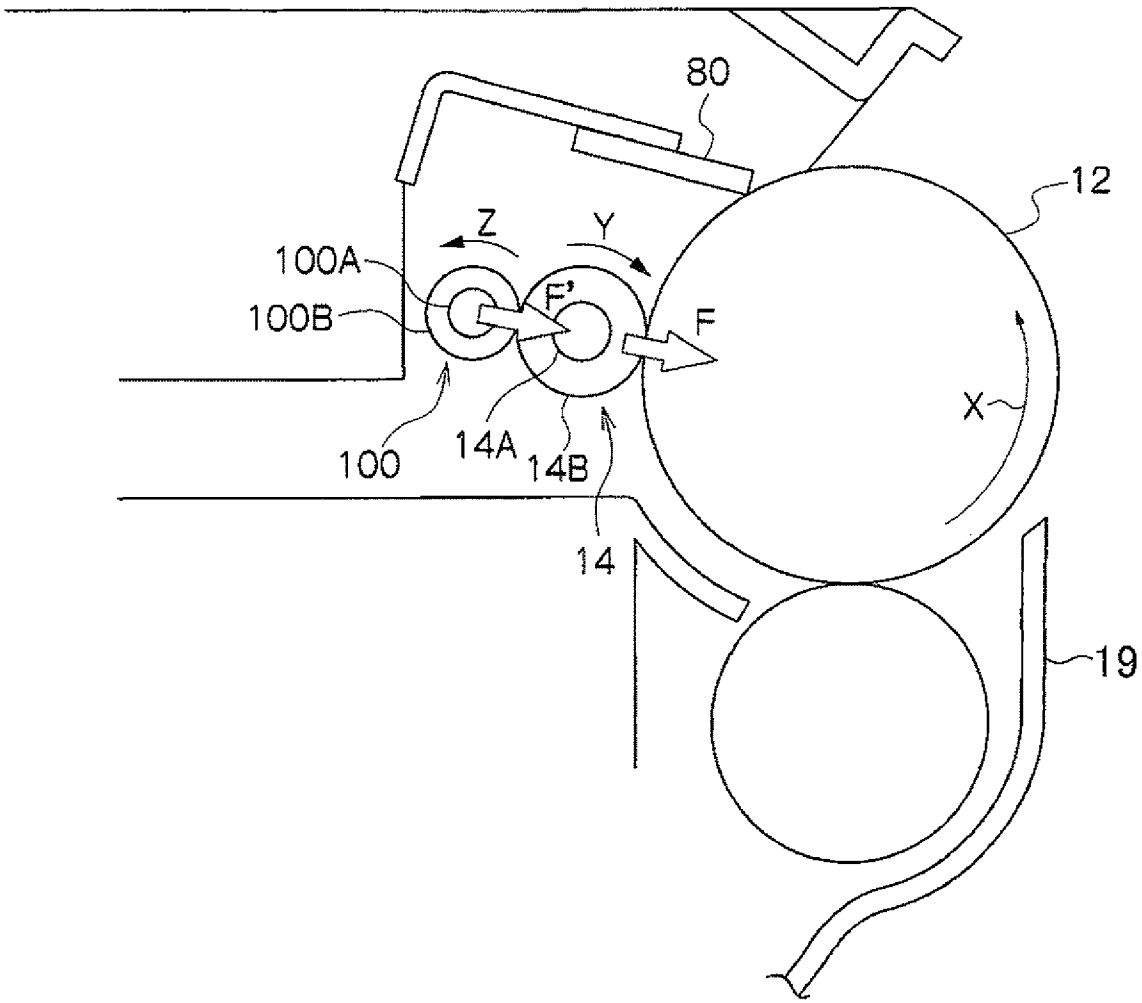
FIG. 10 is an enlarged schematic configuration view showing of the peripheral portion of a charging member (charging device) in FIGS. 8 and 9.

Here, as shown in FIG. 10, for example, the charging member 14 is a roll on which a foamed elastic layer 14B is formed around the conductive core member 14A, and the core member 14A is rotatably supported. The cleaning member 100 of the charging member 14 contacts the side of charging member 14 opposite to the photoreceptor 12, and the charging device (unit) is configured. As the cleaning member 100, the cleaning member 100 according to the present exemplary embodiment is used.

Here, a method is described in which the cleaning member 100 always contacts the charging member 14 and is used so as to be driven by the charging member 14. However, the method may be used in which the cleaning member 100 always contacts the charging member 14 and is driven by it, and a method may be used in which the cleaning member 100 contacts the charging member 14 only at the time of the cleaning of the charging member 14 and is driven by it. In addition, the cleaning member 100 contacts the charging member 14 only at the time of the cleaning of the charging member 14, and may be configured with a circumferential speed difference with respect to the charging member 14 by a separated driving. However, since dirt on the charging member 14 is collected in the cleaning member 100 and is easily reattached to the charging roll in a method in which the cleaning member 100 always contacts the charging member 14 and has the circumferential speed difference, the method is undesirable.

The charging member 14 applies a load F to both ends of the core member 14A, presses the photoreceptor 12, is elastically deformed along the circumferential surface of the foamed elastic layer 14B, and forms a nip portion. In addition, the cleaning member 100 applies a load F' to both ends of the core member 100A and presses the charging member 14, and the foamed elastic layer 100B is elastically deformed along the circumferential surface of the charging member 14 and forms a nip portion. Therefore, bending of the charging member 14 is suppressed, and a nip portion in the axial direction of the charging member 14 and the photoreceptor 12 is formed.

The photoreceptor 12 is rotated in a direction of an arrow X by a motor (not shown), and the charging member 14 is rotatably driven in a direction of an arrow Y according to the rotation of the photoreceptor 12. In addition, the cleaning member 100 is rotatably driven in a direction of an arrow Z according to the rotation of the charging member 14.

Configuration of Charging Member

Hereinafter, a configuration of the charging member will be described. However, the configuration is not limited to a configuration described below.

The configuration of the charging member is not particularly limited. For example, there is a configuration that includes the core member and elastic layer, or a resin layer instead of the elastic layer. The elastic layer may include a single-layer configuration and may include a laminated configuration that includes plural different layers having a number of functions. Moreover, a surface treatment may be performed on the elastic layer.

As a material of the core member, free-cutting steel, stainless steel, or the like is used, and preferably the material and the surface treatment may be appropriately selected according to use of sliding or the like. Moreover, plating may be preferably performed. In the case of the material that does not have conductivity, the material may be processed by a general processing such as the plating and the conducting processing may be performed, and the material may be used without the conducting processing.

The elastic layer is a conductive elastic layer. For example, the conductive elastic layer includes an elastic material such as rubber having elasticity, and a conductive material such as a carbon black or an ion conductive material that adjusts the resistance of the conductive elastic layer, and materials that are generally added to rubber such as softeners, plasticizers, curing agents, vulcanizing agents, vulcanization accelerators, antioxidants, and fillers such as silica or calcium carbonate may be added to the conductive elastic layer as necessary. The conductive elastic layer is formed by coating a mixture to which the material generally added to rubber is added on the circumferential surface of the conductive core member. As a conducting agent that is intended to adjust the resistance value, carbon black that is blended to a matrix material, those in which materials electrically conducting while having at least one of electron or ion as the electric charge carrier are dispersed such as ion conducting agent, and the like are used. In addition, the elastic material may be a foamed body.

For example, the elastic material configuring the conductive elastic layer is formed by dispersing the conducting agent in a rubber material. For example, as the rubber material, silicone rubber, ethylene propylene rubber, epichlorohydrin-ethyleneoxide copolymer rubber, epichlorohydrin-ethyleneoxide allylglycidyl ether copolymer rubber, acrlyonitrile butadiene copolymer rubber, and a blend rubber thereof may be appropriately used. The rubber materials may be foamed or non-foamed.

As the conducting agent, the electron conducting agent or the ion conducting agent is used. As an example of the electron conducting agent, there are fine powder such as carbon black such as ketjen black or acetylene black; pyrolytic carbon or graphite; various conductive metals such as aluminum, copper, nickel, stainless steel or alloy thereof; various conductive metal oxides such as tin oxide, indium oxide, titanium, oxide, tin oxide-antimony oxide solid solution, or tin oxide-indium oxide solid solution; those in which the surfaces of insulating materials are subjected to the conducting processing. In addition, as an example of the ion conducting agent, there are perchlorate and chlorate of onium such as tetraethylammonium or lauryl trimethyl ammonium, or the like; alkali metals such as lithium or magnesium, perchlorate and chlorate of alkali earth metal, or the like.

These conducting agents may be used alone, and two or more conducting agents may be combined and be used. In addition, the added amount of the conducting agent is not particularly limited. However, in the case of the electron conducting agent, a range of from 1 part by weight to 60 parts by weight to 100 parts by weight of a rubber material is preferable, and in the case of the ion conducting agent, a range of from 0.1 part by weight to 5.0 parts by weight to 100 parts by weight of a rubber material is preferable.

A surface layer may be formed on the surface of the charging member. As a material of the surface layer, any material such as resin or rubber may be used, and the material of the surface layer is not particularly limited. For example, polyvinylidene fluoride, ethylene tetrafluoride copolymer, polyester, polyimide, and copolyamide may be appropriately used as the material of the surface.

The copolyamide is one that contains any one kind or plural kinds of 610 nylon, 11 nylon, and 12 nylon as a polymerization unit, and as another polymerization unit that is contained in the copolymer, there are 6 nylon, 66 nylon, and the like. Here, a ratio of the polymerization unit including 610 nylon, 11 nylon, and 12 nylon that is contained in the copolymer is preferably 10% or more summed by weight ratio.

A polymer material may be used alone, or two or more kinds of the polymer materials are mixed and may be used. A number average molecular weight of the polymer material is preferably a range of from 1,000 to 100,000, and is more preferably a range of from 10,000 to 50,000.

In addition, an electrically conducting material may be contained to the surface layer so as to adjust the resistance value. As the electrically conducting material, one having the particle diameter of 3 μm or less is preferable.

In addition, as the conducting agent that is intended to adjust the resistance value, carbon black that is blended to a matrix material, conductive metal oxide particles, those in which materials electrically conducting while having at least one of electron or ion as the electric charge carrier are dispersed such as ion conducting agent, and the like may be used.

Specifically, as the carbon black of the conducting agent, there are "special black 350" manufactured by Degussa Corporation, "special black 100" manufactured by Degussa Corporation, "special black 250" manufactured by Degussa Corporation, "special black 5" manufactured by Degussa Corporation, "special black 4" manufactured by Degussa Corporation, "special black 4A" manufactured by Degussa Corporation, "special black 550" manufactured by Degussa Corporation, "special black 6" manufactured by Degussa Corporation, "color black FW 200" manufactured by Degussa Corporation, "color black FW 2" manufactured by Degussa Corporation, "color black FW 2V" manufactured by Degussa Corporation, "MONARCH 1000" manufactured by Cabot Corporation, "MONARCH 1300" manufactured by Cabot Corporation, "MONARCH 1400" manufactured by Cabot Corporation, "MOGUL-L" manufactured by Cabot Corporation, "REGAL 400R" manufactured by Cabot Corporation, and the like.

The pH of the carbon black is preferably 4.0 or less.

The conducting metal oxide particles that are conducting materials for adjusting the resistance value are particles having conductivity such as tin oxide, antimony-doped tin oxide, zinc oxide, anatase titanium oxide, ITO, or the like, and any conducting particle may be used as long as it is a conducting agent that has an electron as an electric charge carrier and is not particularly limited. The conducting material may be used alone or two or more kinds of the conducting materials may be used in combination. In addition, the conducting material may have any particle diameter, is preferably tin oxide, antimony-doped tin oxide, anatase titanium oxide, and is more preferably tin oxide and antimony-doped tin oxide.

In addition, fluorine-based resin or silicone-based resin is appropriately used on the surface layer. Particularly, the surface layer may be configured of fluorine-modified acrylate polymer. Moreover, particles may be added into the surface layer. In addition, a concave portion is provided on the surface of the charging member by adding insulating particles such as alumina or silica, and therefore, burden resulted when the charging member and the photoreceptor rub each other is decreased, and the mutual abrasion resistance of the charging member and the photoreceptor may be improved.

An outer diameter of the charging member may be preferably from 8 mm to 16 mm. In addition, the method of measuring the outer diameter is performed using commercially available vernier calipers or a laser type outer diameter measuring device.

Micro hardness of the charging member may be preferably from 45° to 60°. In order to decrease the hardness, a method that increases the added amount of plasticizers or that uses materials having low hardness such as silicon rubber may be applied.

In addition, the micro hardness of the charging member may be measured by MD-1 type hardness meter manufactured by Kobunshi Keiki Co., Ltd.

Moreover, in the image forming apparatus according to the present exemplary embodiment, the process cartridge including the photoreceptor (image holding member), the charging device (unit of charging member and cleaning member), the developing device, and the cleaning blade (cleaning device) is described. However, the present invention is not limited thereto. For example, a process cartridge may be used which includes the charging device (unit of the charging member and the cleaning member), and includes the photoreceptor (image holding member), the exposure device, the transfer device, the developing device, the cleaning blade (cleaning device) if necessary. In addition, these devices or members are not necessarily formed in a cartridge, and may be directly disposed in the image forming apparatus.

Moreover, in the image forming apparatus according to the present exemplary embodiment, the aspect at which the charging device is configured in the unit of the charging member and the cleaning member is described, that is, the aspect which adopts the charging member as the member to be cleaned is described. However, the present invention is not limited thereto, and the photoreceptor (image holding member), the transfer device (transfer member; transfer roll), and the intermediate transfer member (intermediate transfer belt) may be the member to be cleaned. Moreover, the unit of the member to be cleaned and the cleaning member that is disposed so as to contact the member to be cleaned may be directly disposed in the image forming apparatus, and similarly as described above, the unit is formed in a cartridge such as the process cartridge and may be disposed in the image forming apparatus.

In addition, the image forming apparatus according to the present exemplary embodiment is not limited to the above-described configuration. For example, well-known image forming apparatuses such as an intermediate transfer type image forming apparatus may be adopted.

EXAMPLES

Hereinafter, the present invention will be described in detail with reference to examples. However, the present invention is not limited to the examples.

Example 1

Manufacturing of Cleaning Roll 1

"Super X No. 8008 (manufactured by Cemedine Co., Ltd)" which is a filler is coated on one surface of a foamed polyurethane sheet having a thickness of 3 mm (EPM-70; manufactured by INOAC Corporation and has a foamed cell diameter of 0.4 mm). The coated fillers are impregnated from one side surface of the foamed polyurethane sheet up to 0.3 mm in the thickness. That is, the fillers are filled in the foamed cells (bubbles) that are present at a region which is from one surface of the foamed polyurethane sheet up to 0.2 mm in the thickness. Thereafter, the sheet is allowed to stand for 60 minutes under an environment of 22° C., and the "super X No. 8008 (manufactured by Cemedine Co., Ltd)" which is the fillers is hardened.

Next, double-sided tape having a thickness of 0.15 mm is stuck to one surface of the foamed polyurethane sheet, and a strip having 6 mm in the width and 243 mm in the length is cut.

Next, the strip is wound around the metal core member (ϕ6 mm in the outer diameter and 331 mm in the entire length) at the winding angle of 25° while applying the tensile strength in such a way that the entire length of the strip is elongated at a rate approximately above 0% to 5%, and the foamed elastic layer in which the strip is helically disposed is formed.

In this way, a cleaning roll 1 that is the cleaning member is obtained.

Example 2

Manufacturing of Cleaning Roll 2

Performed in a similar manner to Example 1 except that the "Super X No. 8008 (manufactured by Cemedine Co., Ltd)" which is a filler is impregnated from one surface of the foamed polyurethane sheet up to 1.5 mm in the thickness (that is, except that the fillers are filled in foamed cells (bubbles) that are present in a region from one surface of the foamed polyurethane sheet up to 1.5 mm in the thickness), a cleaning roll 2 is obtained.

Example 3

Manufacturing of Cleaning Roll 3

Performed in a similar manner to Example 1 except that the "Super X No. 8008 (manufactured by Cemedine Co., Ltd)" which is a filler is coated on the surfaces in one surface of the foamed polyurethane sheet corresponding to both ends in the longitudinal direction (both ends from end sides up to 5 mm toward the center portion) of the strip when the strip is cut, a cleaning roll 3 is obtained.

Example 4

Manufacturing of Cleaning Roll 4

Performed in a similar manner to Example 3 except that the "Super X No. 8008 (manufactured by Cemedine Co., Ltd)" which is a filler is impregnated from one surface of the foamed polyurethane sheet up to 1.5 mm in the thickness (that is, except that the fillers are filled in foamed cells (bubbles) that are present in a region from one surface of the foamed polyurethane sheet up to 1.5 mm in the thickness), a cleaning roll 4 is obtained.

Example 5

Manufacturing of Cleaning Roll 5

Performed in a similar manner to Example 3 except that the "Super X No. 8008 (manufactured by Cemedine Co., Ltd)" which is a filler is impregnated from one surface of the foamed polyurethane sheet up to 3.0 mm in the thickness (that is, except that the fillers are filled in foamed cells (bubbles) that are present in a region from one surface of the foamed polyurethane sheet up to 3.0 mm in the thickness), a cleaning roll 5 is obtained.

Example 6

Performed in a similar manner to Example 1 except that "EP106NL (manufactured by Cemedine Co., Ltd)" that does not have elasticity is used as a filler, a cleaning roll 6 is obtained.

Comparative Example 1

Manufacturing of Comparative Cleaning Roll 1

Performed in a similar manner to Example 1 except that the "Super X No. 8008 (manufactured by Cemedine Co., Ltd)" which is a filler is not coated on one surface of the foamed polyurethane sheet, a comparative cleaning roll is obtained.

Evaluation

Characteristic Evaluation

The region in which the fillers are filled in the foamed cells of the foamed elastic layer of the cleaning rolls obtained in each Example is cut from the core metal, and samples having the length of 30 mm are obtained.

In addition, after the samples are bent at the position of 15 mm in the length, the samples are allowed to stand for 10 minutes, and the presence or absence of the elasticity of the fillers is examined according to the presence or absence of the bending.

Evaluation with Actual Machine

The cleaning rolls obtained from each Example are mounted so as to be driven in accordance with the charging roll of DOCUPRINT C2110 which is a color copying machine (manufactured by Fuji Xerox Co., Ltd.).

In addition, a printing test of 100,000 sheets in an A4 size is performed. After the printing test ends, whether or not the peeling of the ends in longitudinal direction of the foamed elastic layer of each of the cleaning rolls is present is determined by visual inspection. In addition, the state of the peeling occurrence of the foamed elastic layer of the cleaning roll that is determined here indicates a state where one end or both ends in the longitudinal direction of the foamed elastic layer are separated by more than 1 mm from the core member.

In addition, a half tone image quality having 30% density is printed to the $100{,}000^{th}$ sheet of the A4 size, estimation on cleaning performance (contamination streak of charging roll) and the damage of the charging roll are performed, and the cleaning performance is determined.

The evaluation criteria are as follows.

Peeling Evaluation Determination Criteria

A: peeling does not occur

C: peeling occurs

Evaluation of Cleaning Performance: Determination Criteria

A: streak defect on image quality due to contamination streak of charging roll does not occur.

B: streak defect on image quality due to contamination streak of charging roll slightly occurs, but which is acceptable level.

C: streak defect on image quality due to contamination streak of charging roll occurs, and which is unacceptable level.

Evaluation of Damage of Charging Roll: Determination Criteria

A: Damage does not occur on charging roll

B: Damage slightly occurs on charging roll, but which is acceptable level.

C: Damage occurs on charging roll.

Polymer Material . . . 100 parts by weight (copolyamide) aramine CM 8000: manufactured by Toray Inc.)

Conducting Agent . . . 30 parts by weight (antimony-doped tin oxide) SN-100P: manufactured by Ishihara Sangyo Kaisha, Ltd.

Solvent (methanol) . . . 500 parts by weight

Solvent (butanol) . . . 240 parts by weight

TABLE 1

| | Filler | | | | Evaluation | | |
|---|---|---|---|---|---|---|---|
| | Filler Present or Absent | Elasticity of Filler Present or Absent | Present Region (Longitudinal Direction of Foamed Elastic Layer) | Present Region (Thickness Direction of Foamed Elastic Layer) | Peeling | Cleaning Performance | Charging Roll Damage |
| Example 1 | Present | Elasticity Present | Entire Surface | 0 to 7% (0 to 0.2 mm) | A | A | A |
| Example 2 | Present | Elasticity Present | Entire Surface | 0 to 50% (0 to 1.5 mm) | A | A | A |
| Example 3 | Present | Elasticity Present | Both Ends | 0 to 7% (0 to 0.2 mm) | A | A | A |
| Example 4 | Present | Elasticity Present | Both Ends | 0 to 50% (0 to 1.5 mm) | A | A | A |
| Example 5 | Present | Elasticity Present | Both Ends | 0 to 100% (0 to 3.0 mm) | A | A | A |
| Example 6 | Present | Elasticity Absent | Entire Surface | 0 to 7% (0 to 0.2 mm) | A | B | B |
| Comparative Example 1 | Absent | — | — | — | C | C | A |

In the present region (thickness direction), for example, "0 to 7%" indicates a region from the lower surface of the foamed elastic layer up to 7% of total thickness of the foamed elastic layer.
In the present region (thickness direction), for example, "0 to 0.2 mm" indicates a region from the lower surface of the foamed elastic layer up to 0.2 mm of the thickness of the foamed elastic layer.

Manufacturing of Charging Roll

In addition, the charging roll that is applied to the present evaluation is manufactured according to the following manufacturing method and used.

Formation of Foamed Elastic Layer

The following mixture is kneaded by an open roll, the mixture is coated on the surface of a conductive support that formed of SUS 416 and has a diameter of 6 mm in a cylindrical shape so as to be 3 mm in the thickness, the coated mixture enters a cylindrical mold having an inner diameter of 18.0 mm and is vulcanized for 30 minutes at 170° C., and after the vulcanized mixture is discharged from the mold, the discharged mixture is ground, and a cylindrical conductive foamed elastic layer A is obtained.

Rubber Material . . . 100 parts by weight (epichlorohydrin-ethyleneoxide-allylglycidyl ether copolymer rubber) Gechron 3106 (manufactured by Japan Zeon Corporation)

Conducting Agent (carbon black asahi thermal: manufactured by Asahi Carbon Co., Ltd.) . . . 25 parts by weight Conducting Agent (ketjen black EC: manufactured by Lion Corporation) . . . 8 parts by weight Ion Conducting Agent (lithium perchlorate) . . . 1 part by weight Vulcanizing Agent (Sulfur) 200 meshes: manufactured by Tsurumi Chemical Industry Co., Ltd . . . 1 part by weight Vulcanization Accelerator (noccelar DM: manufactured by Ouchi Shinko Chemical Industry Co., Ltd . . . 2.0 parts by weight Vulcanization Accelerator (noccelar TT: manufactured by Ouchi Shinko Chemical Industry Co., Ltd . . . 0.5 part by weight Formation of Surface Layer The following mixture is dispersed in a bead mill, the obtained dispersion liquid A is diluted with methanol, and the diluted liquid A is dip-coated on the surface of the conductive foamed elastic layer A, and then is heated and dried for 15 minutes at 140° C., the surface layer having the thickness of 4 μm is formed, and a conductive roll is obtained. This is used as the charging roll.

From the above results, compared to Comparative Example 1, in the Present Examples 1 to 6, it is understood that the peeling of the foamed elastic layer of the cleaning roll does not occur.

Compared to Example 6, in Present Examples 1 to 5, the cleaning performance is excellent and the damage of the charging roll is suppressed.

In addition, in the Present Example 5, with respect to Evaluation with Actual Machine, the printing is further carried out, and it is found that the damage of the charging roll slightly occurs.

In addition, in the Present Example 6, with respect to Evaluation with Actual Machine, the printing is further carried out, and it is found that the peeling of the ends in the longitudinal direction of the foamed elastic layer slightly occurs.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a core member;

a foamed elastic layer that is disposed so as to helically wind a strip shaped foamed elastic member from one end of the core member to the other end thereof in an outer circumferential surface of the core member, wherein the foamed elastic layer comprises filled bubbles that are filled in with fillers and empty bubbles that are not filled with the fillers, wherein the filled bubbles are present at a surface of a side opposing the outer circumferential surface of the core member in at least one side or both sides of ends in a longitudinal direction in the foamed elastic layer, and wherein the empty bubbles are present in a portion of the foamed elastic layer spaced apart from the outer circumferential surface of the core member; and a bonding layer that bonds the core member and the foamed elastic layer.

2. The cleaning member according to claim 1, wherein the fillers are filled in the filled bubbles that are present at a region from the surface of the side opposing to the outer circumferential surface of the core member up to 0.2 mm of the foamed elastic layer along a thickness direction of the foamed elastic layer in at least one side or both sides of the ends in the longitudinal direction of the foamed elastic layer.

3. The cleaning member according to claim 1, wherein the fillers are filled in the filled bubbles that are present at a region from the surface of the side opposing to the outer circumferential surface of the core member up to 0.6 mm of the foamed elastic layer along a thickness direction of the foamed elastic layer in at least one side or both sides of the ends in the longitudinal direction of the foamed elastic layer.

4. The cleaning member according to claim 1, wherein the fillers are filled in the filled bubbles that are present at a region from the surface of the side opposing to the outer circumferential surface of the core member up to half a thickness of the foamed elastic layer along a thickness direction of the foamed elastic layer in at least one side or both sides of the ends in the longitudinal direction of the foamed elastic layer.

5. The cleaning member according to claim 1, wherein the fillers are filled in the filled bubbles that are present at a region from the surface of the side opposing to the outer circumferential surface of the core member up to a ¼ a thickness of the foamed elastic layer along a thickness direction of the foamed elastic layer in at least one side or both sides of the ends in the longitudinal direction of the foamed elastic layer.

6. The cleaning member according to claim 1, wherein the fillers have elasticity.

7. The cleaning member according to claim 1, wherein the fillers include a polyurethane resin.

8. The cleaning member according to claim 1, wherein the fillers include a silicone resin.

9. A charging device comprising:

a charging member that charges a member to be charged; and the cleaning member according to claim 1 as a cleaning member that is disposed so as to contact a surface of the charging member and cleans the surface of the charging member.

10. A process cartridge comprising at least the charging device according to claim 9, wherein the process cartridge is detachable from an image forming apparatus.

11. An image forming apparatus comprising:

an image holding member;

a charging device according to claim 9 that charges a surface of the image holding member;

a latent image forming device that forms a latent image on the surface of the charged image holding member;

a developing device that develops the latent image formed on the image holding member using a toner and forms a toner image; and a transfer device that transfers the toner image to a transfer medium.

12. A unit for an image forming apparatus comprising:

a member to be cleaned; and the cleaning member according to claim 1 as a cleaning member that is disposed so as to contact a surface of the member to be cleaned and cleans the surface of the member to be cleaned.

13. A process cartridge comprising at least the unit for the image forming apparatus according to claim 12, wherein the process cartridge is detachable from the image forming apparatus.

14. An image forming apparatus comprising the unit for the image forming apparatus according to claim 12.

* * * * *